US007971845B2

(12) United States Patent
Galant

(10) Patent No.: US 7,971,845 B2
(45) Date of Patent: Jul. 5, 2011

(54) SECURITY MOUNT FOR DISPLAYING HANDHELD DEVICE

(75) Inventor: Steve N. Galant, Kleinburg (CA)

(73) Assignee: Compucage International Inc. (CA)

( * ) Notice: Subject to any disclaimer, the term of this patent is extended or adjusted under 35 U.S.C. 154(b) by 91 days.

(21) Appl. No.: 12/405,318

(22) Filed: Mar. 17, 2009

(65) Prior Publication Data

US 2009/0229089 A1 Sep. 17, 2009

Related U.S. Application Data

(60) Provisional application No. 61/037,194, filed on Mar. 17, 2008.

(51) Int. Cl.

| | |
|---|---|
| ***A47H 1/10*** | (2006.01) |
| ***H01J 5/00*** | (2006.01) |
| ***F16M 13/00*** | (2006.01) |
| ***A47G 29/00*** | (2006.01) |

(52) U.S. Cl. ..... 248/551; 174/50; 248/329; 248/685

(58) Field of Classification Search ..... 248/551, 248/693, 550; 70/14, 19, 57, 57.1, 58, 59, 70/61, 174, 275, 277, 278.1, 278.7, 279.1, 70/432, 434, 439, 441

See application file for complete search history.

(56) References Cited

U.S. PATENT DOCUMENTS

| | | | | |
|---|---|---|---|---|
| 4,620,182 | A | 10/1986 | Keifer | |
| 5,146,205 | A | 9/1992 | Keifer et al. | |
| 5,341,124 | A | 8/1994 | Leyden et al. | |
| 5,421,667 | A | 6/1995 | Leyden et al. | |
| 5,988,584 | A | 11/1999 | Perry | |
| 6,060,661 | A | 5/2000 | O'Neill | |
| 6,659,382 | B2 | 12/2003 | Ryczek | |
| 6,761,579 | B2 | 7/2004 | Fort et al. | |
| 6,896,543 | B2 | 5/2005 | Fort et al. | |
| 7,053,774 | B2 * | 5/2006 | Sedon et al. | 340/568.2 |
| 7,154,039 | B1 * | 12/2006 | Marszalek et al. | 174/50 |
| 2008/0156959 | A1 * | 7/2008 | Fawcett et al. | 248/551 |

OTHER PUBLICATIONS

Sennco Solutions, Inc., Our Products, Specializing in All Your Retail Security Needs, Internet Brochure 2005.

Swiveline, The Latest Innovation in Retractors, 360 Degree Innovation Designed to Look As Good As It Works, Internet Brochure 2006.

* cited by examiner

*Primary Examiner* — Amy J Sterling
*Assistant Examiner* — Erin Smith
(74) *Attorney, Agent, or Firm* — Krugliak, Wilkins, Griffiths & Dougherty Co., L.P.A.; David P. Dureska; Brent L. Moore

(57) ABSTRACT

A security mount for displaying an article such as a handheld device is provided that includes a device mount that can be secured to a handheld device and a base mount that can be secured to a display structure. The device mount is releasably connected to a tether such that the device mount can be detached from the tether without detaching the device mount from the handheld device.

18 Claims, 12 Drawing Sheets

SECURITY MOUNT FOR DISPLAYING HANDHELD DEVICE

This Application claims priority to and the benefit of U.S. Provisional Patent Application No. 61/037,194 filed Mar. 17, 2008, which is incorporated herein by reference.

BACKGROUND

Example embodiments described herein relate to display mounts for handheld or mobile devices.

It is common in retail environments to display handheld devices such as cell phones, cameras, video gaming devices, perfume and cologne bottles and the like in a manner that allows potential customers to pick up and look at the device, while at the same time preventing unauthorized removal of the device. For example, handheld devices are often anchored to a display surface by means of a retractable tether.

An improved tether-style mount for displaying handheld devices is desired.

SUMMARY

According to one example embodiment is a security mount for displaying a handheld device is provided that includes a device mount that is configured to allow the handheld device to be quickly released from and attached to a tether.

According to one example embodiment a security mount for displaying an article such as a handheld device is provided that includes a device mount that can be secured to a handheld device and a base mount that can be secured to a display structure. The device mount is releasably connected to a tether such that the device mount can be detached from the tether without detaching the device mount from the handheld device. In an example embodiment, a front surface of the base mount and a back surface of the device mount each have a complimentary shape such that the device mount is biased to a predetermined orientation relative to the base mount as the device mount back surface is retracted into engagement with the base mount front surface.

According to one example embodiment is a mounting assembly for releasably securing a handheld device to a tether having an enlarged terminal portion at an end of a tethering cable, comprising: a rigid device mount securable to a handheld device, the device mount defining an internal cavity for receiving the enlarged terminal portion of the tether, and a cable passage for receiving a section of the tethering cable adjacent the enlarged terminal portion, the cable passage extending from the internal cavity to an outer surface of the device mount, the device mount defining an access opening communicating with the internal cavity and the cable passage at a first side of the device mount to permit the enlarged terminal portion and the tethering cable section to be positioned into and removed from the internal cavity and the cable passage, respectively; and a cover releasably securable to the device mount to cover the access opening when the cover is in a secured position to prevent removal of the tether from the device mount.

According to another example embodiment is a security device for releasably securing an article, comprising: a retracting mechanism including a retractable tether having an enlarged terminal portion at an end of a tethering cable; a device mount assembly comprising: (i) a rigid device mount body securable to the article, the device mount body defining an internal cavity receiving the enlarged terminal portion of the tether, and a cable passage for receiving a section of the tethering cable adjacent the enlarged terminal portion, the cable passage extending from the internal cavity to an outer surface of the device mount body, the device mount body defining an access opening communicating with the internal cavity and the cable passage to permit the enlarged terminal portion and the tethering cable section to be positioned into and removed from the internal cavity and the cable passage, respectively and (ii) a cover releasably secured to the device mount body to cover the access opening when the cover is in a secured position to prevent removal of the tether from the device mount body; and a base mount for mounting to a support structure and having an outer facing front surface for engaging the back side of the device mount when the device mount is retracted towards the base mount.

DETAILED DESCRIPTION

Figure 1:
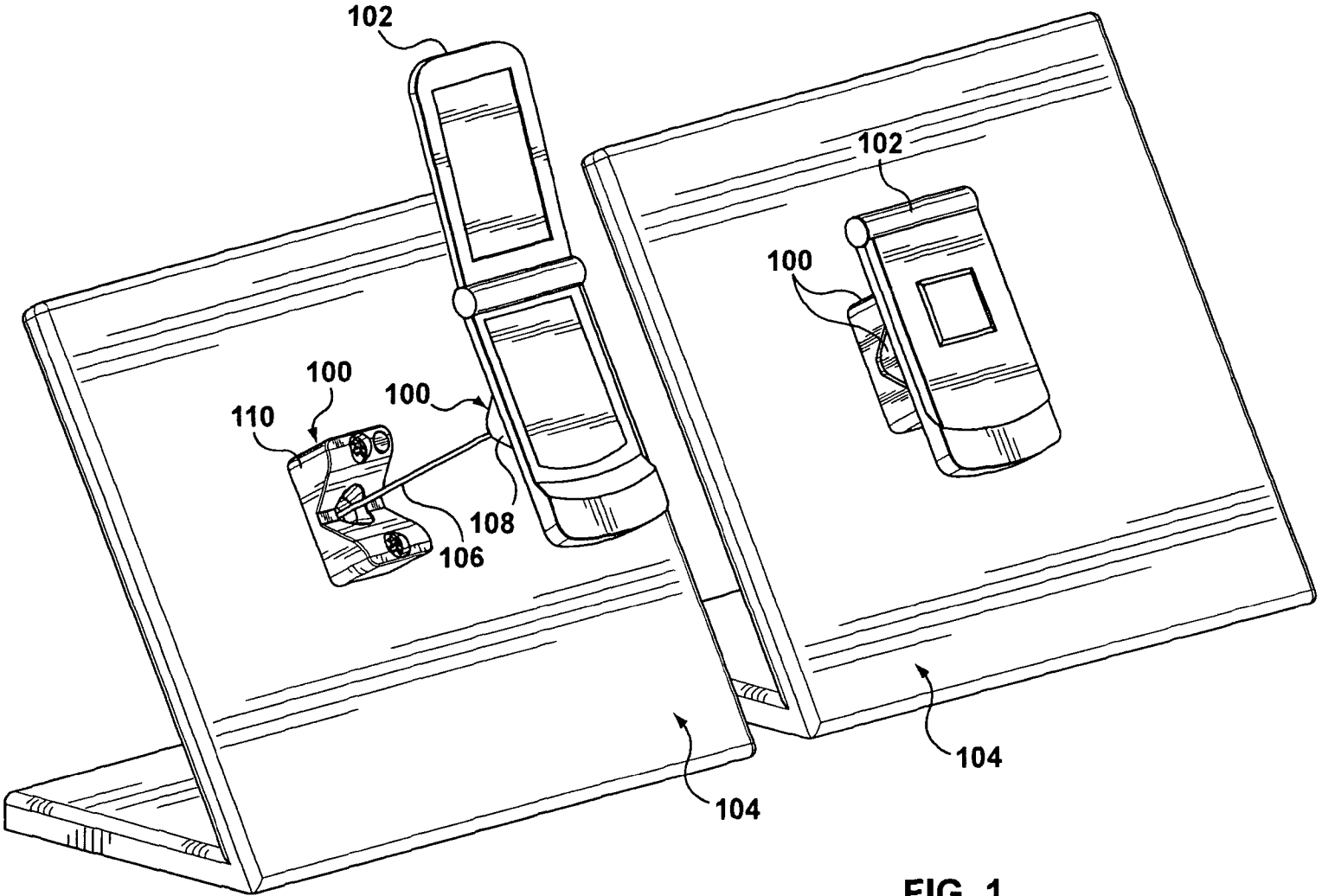
FIG. 1 is a perspective view illustrating handheld devices secured to a display stand using a security mount according to an example embodiment.

FIG. 1 shows handheld mobile devices 102, which in the illustrated example are mobile phone enabled devices, secured to display stands 104. Each of the handheld devices 102 is secured using a tethering security mount 100 according to example embodiments of the invention. Each security mount 100 allows its associated handheld device 102 to be pulled away from the display surface into an extended tethered position such as the handheld device 102 that is connected to the left-most stand 104, and retracted back to the display surface to a retracted position such as the handheld device 102 that is connected to the right-most stand 104. As will be explained in greater detail below, in example embodiments the security mount 100 is configured to allow a displayed handheld device 102 to be quickly released from its tether 106 by an authorized party so that it can be moved to a new display location. In at least some example embodiments, the security mount 100 is configured to automatically orient the handheld device 102 in a predetermined orientation when it is in the retracted position.

Although handheld device 102 is shown as a mobile phone enabled device, the security mount 100 can be used in various configurations to secure many types of handheld mobile devices including but not limited to personal digital assistants, smart phones and other phone-enabled devices, digital media players, cameras, GPS receivers, TV remotes or video gaming devices, and non-electronic handheld devices such as perfume and cologne bottles and other articles that are susceptible to theft or innocent misplacement. The display stand 104 illustrated in the Figures is merely illustrative and the security mount 100 can be used with many different types of display surfaces or counters or stands.

Figure 2:
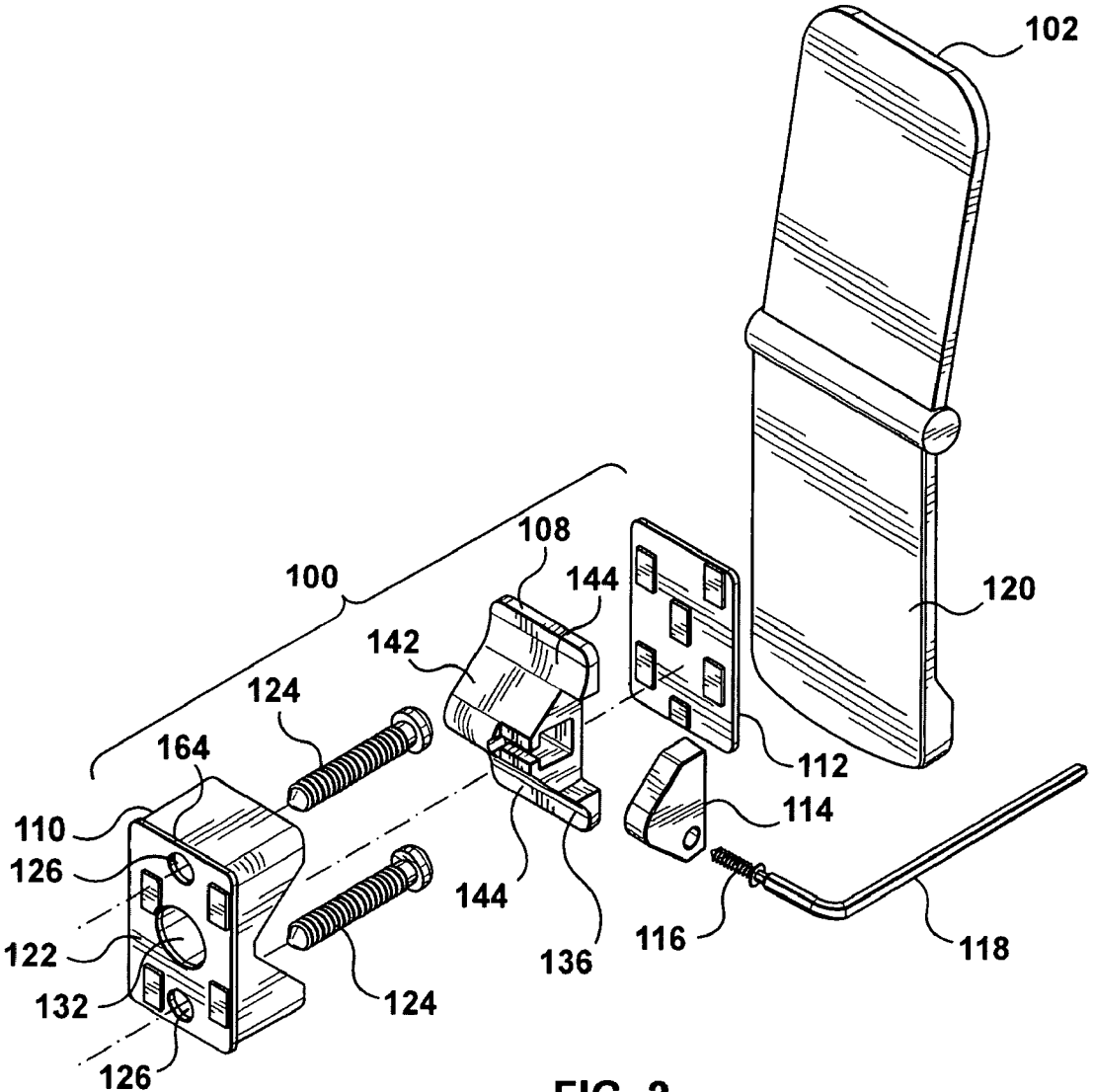
FIG. 2 is a perspective view of the security mount.
Figure 3:
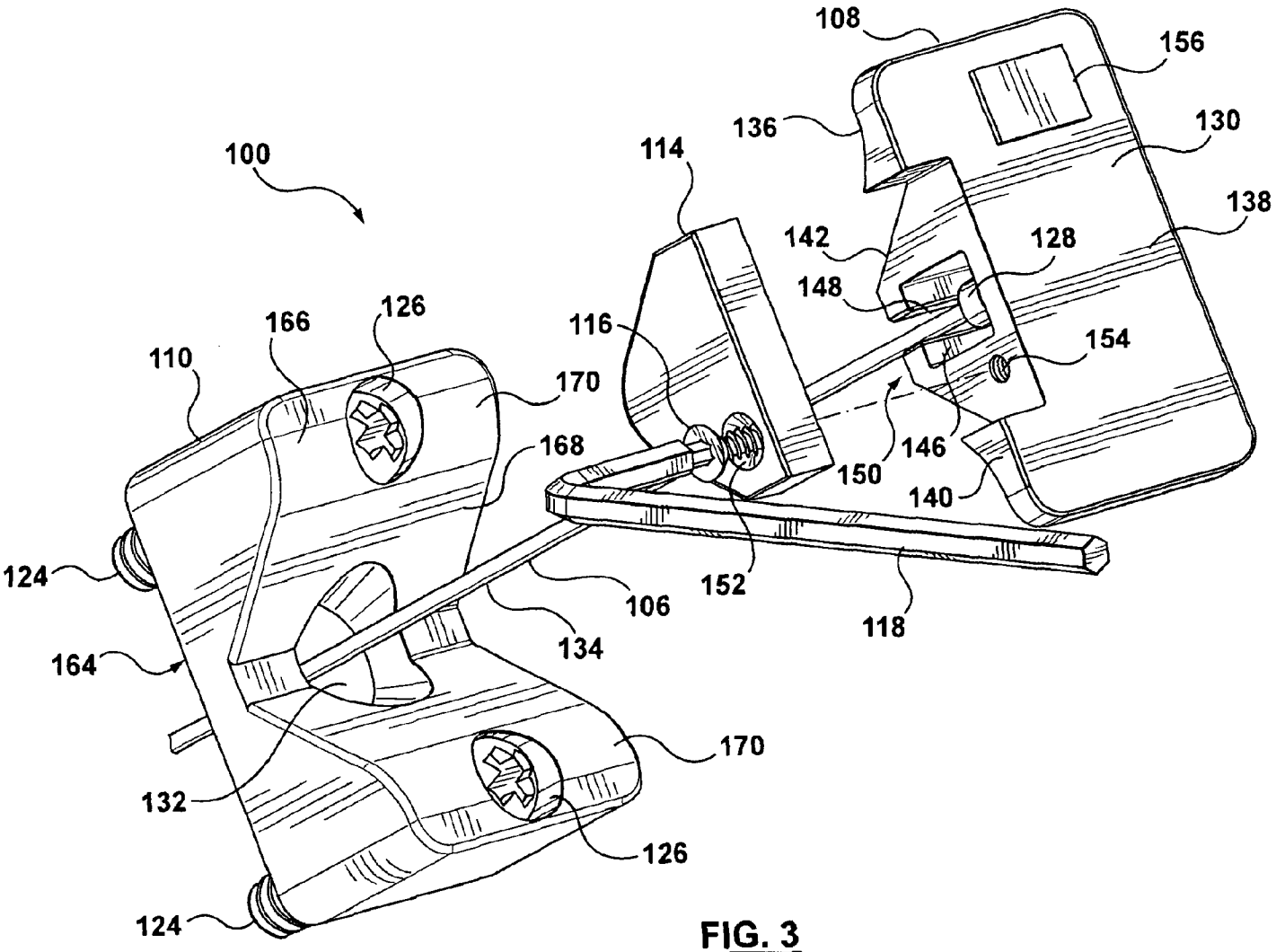
FIG. 3 is a further perspective view of the security mount.
Figure 4:
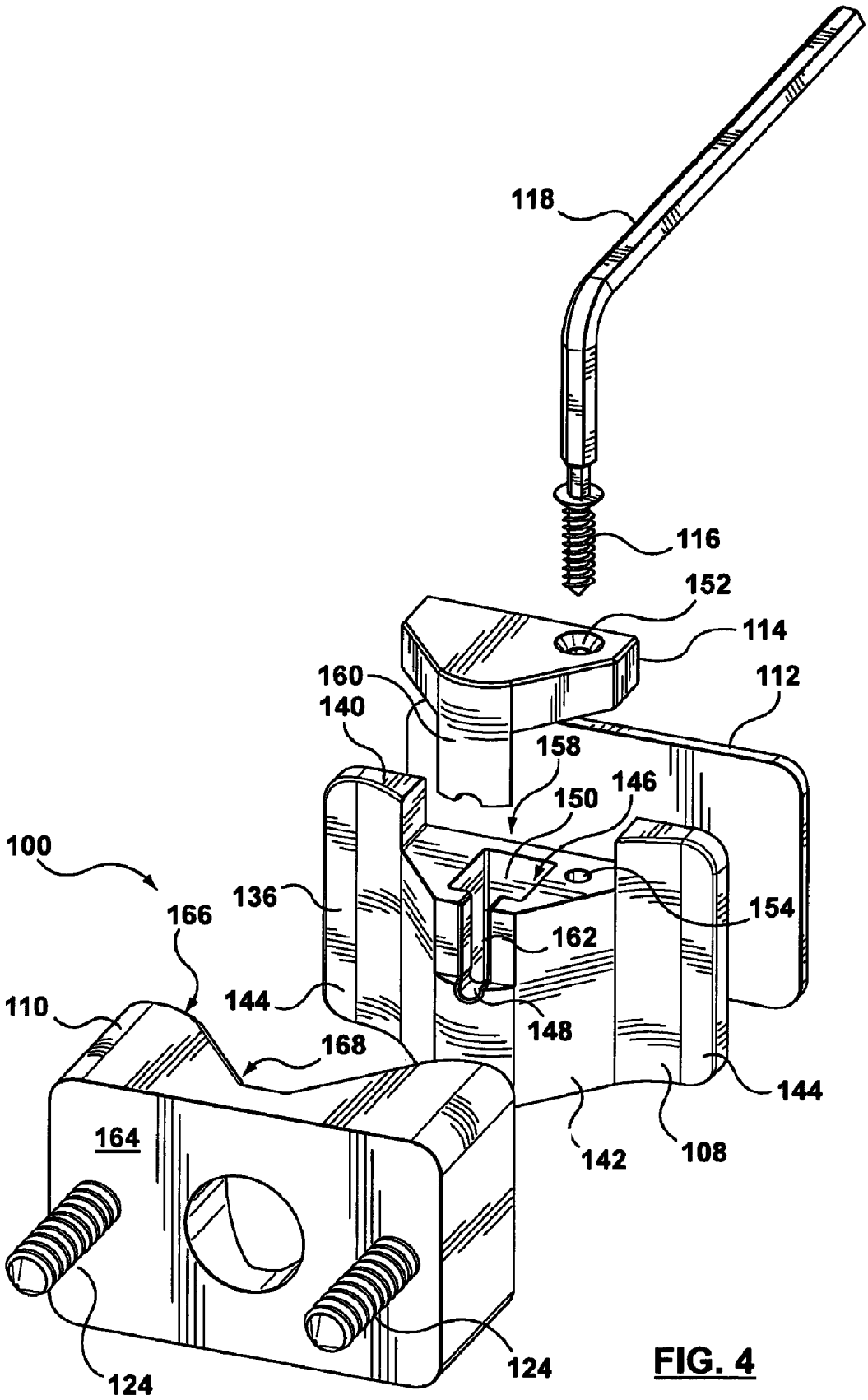
FIG. 4 is a further perspective view of the security mount.

FIGS. 2-4 each show components of the security mount 100 in greater detail. The security mount 100 includes a rigid device mount unit 108 that is configured for attachment to the handheld device 102, and a rigid base mount unit 110 that is configured to be mounted to a surface of a display stand 104. The device mount 108 and base mount 110 are in an example embodiment each formed from injection molded plastic, however they could be formed from other rigid materials such as metals or composites for example.

The device mount 108 and its associated components will now be described in greater detail. The device mount 108 has a body with generally opposite facing back and front sides 136, 138. As best seen in FIG. 3, in an example embodiment, the front side 138 defines a substantially planar front surface 130 to which a double sided bonding tape 112 (FIGS. 2 and 4) is attached. The double sided tape 112 is used to secure the device mount 108 to a planar surface 120 (FIG. 2) of the handheld device 102. The back side 136 of the device mount 109 in the illustrated embodiment defines a central backward extending wedge shaped portion 142 that is flanked by upper and lower flattened curved portions 144. In order to allow the device mount 108 to be connected to a tether 106, the device mount 108 defines an internal central cavity 146 housed within the wedge shaped portion 142. A cable passage 148 extends rearward from the central cavity 146 and out through the back surface of the back side 136. A first side 140 of the device mount that extends from the front side 138 to the back side 136 defines a lateral tether access opening 150 to the central cavity 146 and cable passage 148 which can be closed with a releasable side cover 114.

As seen in FIG. 3, in an example embodiment, the tether 106 includes a tether cable 134 that has an enlarged terminal end 128. The central cavity 146 is dimensioned to receive the enlarged terminal end 128, and the cable passage 148 is dimensioned to allow a portion of the cable 134 that is adjacent the enlarged terminal end 128 to pass to the outside of the device mount 108. The cable passage 148 has a cross-sectional area that is smaller than the cross-sectional area of the central cavity 146 and the enlarged terminal end 128 such that the enlarged terminal end 128 cannot be pulled through the cable passage 148. Thus, the device mount 108 defines a seat at the back side of the central cavity 146 for engaging the enlarged terminal end 128 to prevent unauthorized removal of the tether from the device mount 108. The tether access opening 150 allows the tether's enlarged terminal end 128 and an adjacent section of cable to be laterally slid into (or out of) the cavity 146 and cable passage 148 from the first side 140 of the device mount 108. Once the tether's enlarged terminal end 128 and an adjacent section of cable have been slid into the cavity 146 and cable passage 148, the tether 106 can be secured to the device mount 108 by securing the releasable side cover 114 to the device mount 108 to cover the tether access opening 150. In an example embodiment, the side cover 114 is secured by a screw 116 that passes through a countersunk hole 152 in the side cover 114 and into a mating threaded bore 154 provided in the first side of the device mount 108. Although only a single screw 116 is shown in the Figures, multiple securing screws 116 could be used.

In at least some example embodiments, the securing screw 116 is keyed with a unique or uncommon tool receptacle in its head such that a specialized or custom provided tool 118 is required to unscrew the securing screw 116, thus mitigating against unauthorized removal of the security screw 116.

Accordingly, when the side cover 114 is in a secured position, the tether 106 cannot be removed from the device mount 108 without the specialized tool 118. However, with specialized tool 118, the side cover 114 can be quickly released and the tether 106 removed from the device mount 108. The side cover 114 is accessible and releasable without removing the device mount 108 from the handheld device 102 to which it has been secured by double sided adhesive 112. Thus, the device mount 108 stays secured to the handheld device once the tether 106 is removed. The handheld device 102 can then quickly and easily be secured to another tether 106 in a display area. Such a configuration allows multiple handheld devices 102 to be quickly rearranged in display area.

In one example embodiment, as an added security precaution an RFID tag 156 (FIG. 3) is secured to the front surface 130 of the device mount 108 or integrated into double sided adhesive 112 or otherwise secured to the device mount 108 so that if an attempt is made to remove a handheld device having a device mount 108 beyond the RFID interrogator at a point of exit security system an alarm will sound. Thus, in the event that a tether is inadvertently or purposefully removed from a handheld device, an additional layer of security is provided.

The device mount 108 and side cover 114 are sized and configured to be relatively unobtrusive when a customer is handling the mobile device 102.

As shown in FIG. 4, in the illustrated embodiment the side cover 114 has a generally flat triangular shape that corresponds to a side profile of the wedge shaped portion 142 of the device mount 108, and a nested cover seat 158 is provided in the side of the device mount 108 so that the side cover 114 sits flush with the rest of the device mount 108 when in its secured position. The side cover 114 can include a lateral flange 160 that is used to cover a back side slot-like portion 162 of the access opening 150 that leads to the cable passage 148. When the side cover 114 is in its secured position, the distal end of flange 160 can define part of the cable passage 148 and thus limit lateral movement of the tether terminal end 128 within the device mount 108.

The base mount 110 that cooperates with device mount 108 will now be described in greater detail. As shown in FIGS. 2-4, the base mount 110 has a substantially planar back side 164 and a substantially opposite facing front side 166. In some example embodiments a piece of double sided adhesive tape 122 is provided on the back side 164 for securing the base mount 110 to a display surface. Alternatively or additionally, countersunk screw holes 126 can be provided from the front side 166 through to the back side 164 of the base mount 110 to accept securing screws 124 for securing the device mount 108 to a display stand or surface. In an example embodiment the front side 166 of the base mount 110 defines a central inwardly V-shaped surface or portion 168 that is flanked by upper and lower outwardly opening rounded sections 170. Thus, the front side 166 of the base section defines a female receptacle that is complimentary in shape to the male wedge shape of the back side of the device mount 136. These complimentary shapes provide a self-aligning function in that when the device mount 108 is retracted towards the base mount 110, the upper and lower rounded sections 170 guide the wedge shaped device mount portion 142 towards the central V-shaped region 168, which in turn acts on the wedge portion 142 to correctly align the device mount 108 relative to the base mount 110, thereby biasing the handheld device into a correct display orientation. As seen in FIG. 3, a central cable opening 132 is provided through the base section 110 at the apex of the V-shaped section 168. The tether 106 passes through the opening 132.

Figure 5:
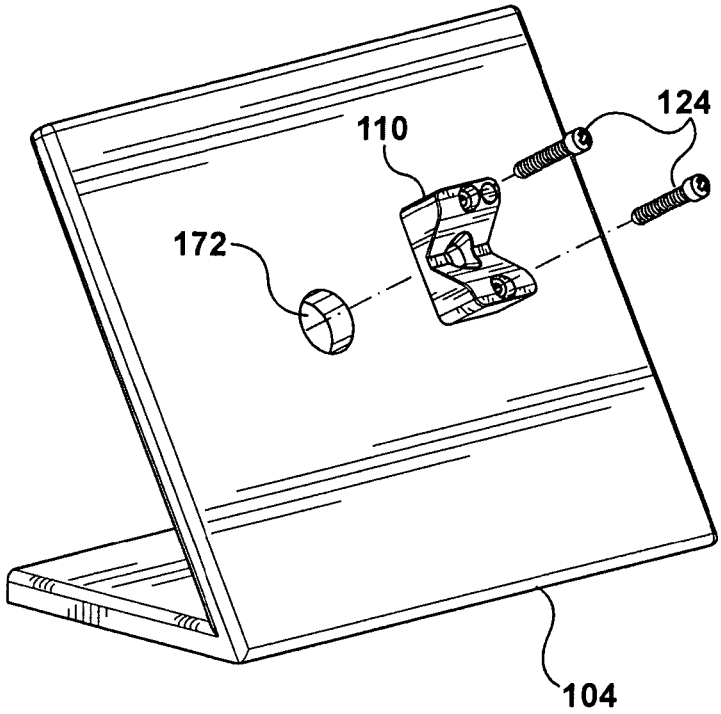
FIG. 5 is a perspective view illustrating installation of a base mount of the security mount of FIG. 1 to a display stand.
Figure 6:
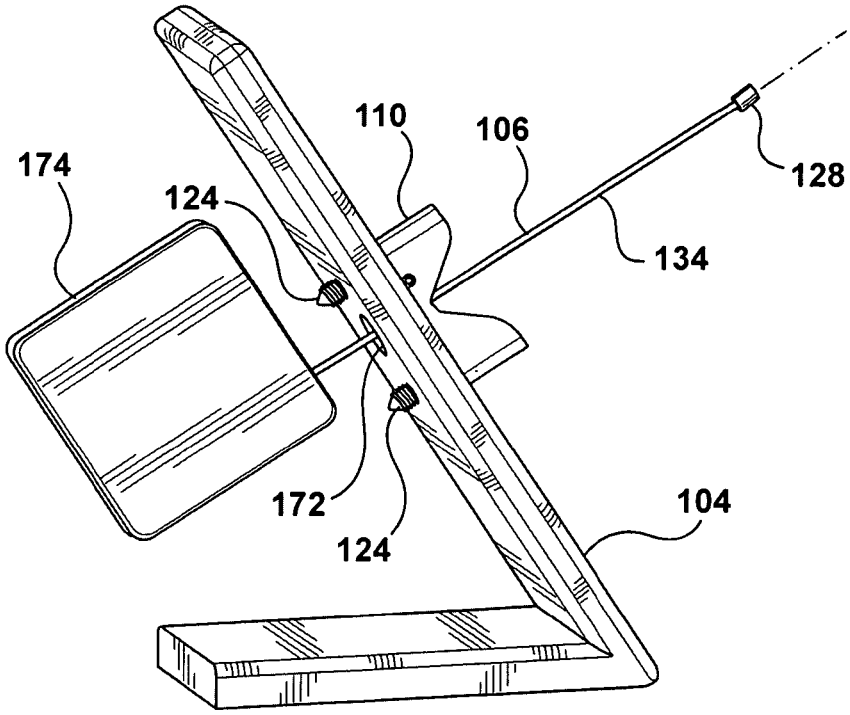
FIG. 6 is a further perspective view illustrating installation of a base mount of the security mount to a display stand.

As illustrated in FIGS. 5 and 6, the cable opening 132 through the base section 110 can be aligned with a complementary opening 172 in a display stand 105. As shown in FIG. 6, the enlarged terminal end 128 of the tether 106 can be fed from behind the display stand 104 and through the aligned display stand opening 172 and base mount opening 132 so that it can then be secured to a device mount 108 such as shown in FIG. 1. As shown in FIG. 6, the tether 106 is mounted on a spring loaded retracting mechanism 174 (also known as a re-coiler) that includes an internal spool for the tether cable 138. The retracting mechanism 174 is biased to automatically reel in (retract) the cable 138 when the cable end 128 is not being pulled in the opposite direction. In one example embodiment, the cable retracting mechanism 174 secures the tether 106 to the display stand 104 in that the mechanism 174 is too large to be pulled through openings 172 or 132. In some example embodiments, the base mounts 110 are integrally formed with the display stand 104.

It will be noted that in the illustrated embodiments the tether access opening 150 on device mount 108 allows the tether 106 to be completely released from the device mount 108 (or attached to the device mount 108) without requiring the enlarged terminal portion 128 to be clipped off or removed from the tether cable 134. Thus, the tether 106 can be secured to and removed from the rest of the security mount 100 without physically altering the tether 106 or removing its enlarged terminal end 128 or its retracting mechanism 174. In example embodiments, the cavity 146 and access opening 150 of device mount 108 are sized to accommodate tethers having a variety of different types and sizes of enlarged terminal ends 128, thus providing a quick change over universal device mount that can be used with different types of tethers 106 and retracting mechanisms 174 from different manufacturers. For example, depending on the type of tether 106, the enlarged terminal end portion 128 may, among other things, be crimped on to the end of the tether cable, or screwed on, or tied on, or welded on and may be a variety of sizes. In some cases, electronic theft-resistant tethers can be used in which a sensor is incorporated into the enlarged terminal portion 128 so that if the tether cable is cut an alarm sounds. The device mount 108 and cover 114 can be sized to accommodate many different types of tethers 106 such that crimped, screwed on, tied on, glued on, welded on, and/or sensor incorporating enlarged terminal tether end portions 128 of such tethers can be used with the security device 100. Thus, the base mount 110 and device mount 108 and its associated cover can be sourced from one supplier and easily used with tethers 106 (and associated retracting mechanisms 174) obtained from one or more other suppliers. Such a configuration allows a mobile device to be easily moved, for example, from a more expensive sensor incorporating anti-theft tether to a less expensive tether within a retail display as the mobile device declines in value and is less likely to be stolen. For example, a new model of a new mobile smart phone may be a prime theft target, requiring a sensor monitored tether, however as the displayed phone itself becomes worn from handling and is superseded by later models, it can be moved to a less expensive non-monitored tether.

Although double sided tape 112 is described above for securing the device mount 108 to a handheld device, other securing mechanisms could be used such as cable ties, screws or a clamping structure, for example.

Figure 8:
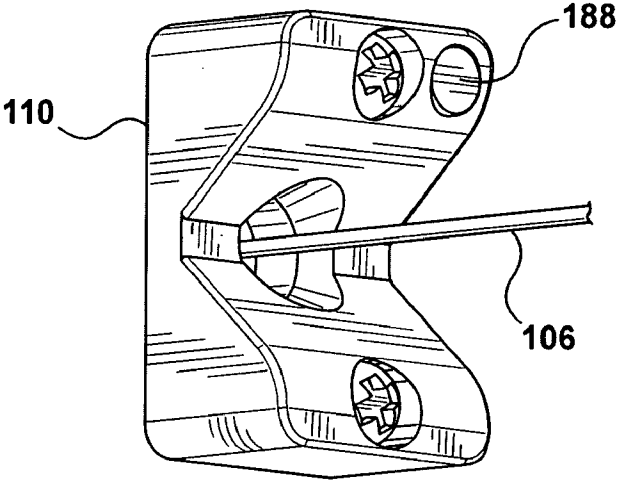
FIG. 8 is a perspective view showing a base mount of the security mount of FIG. 7.
Figure 7:
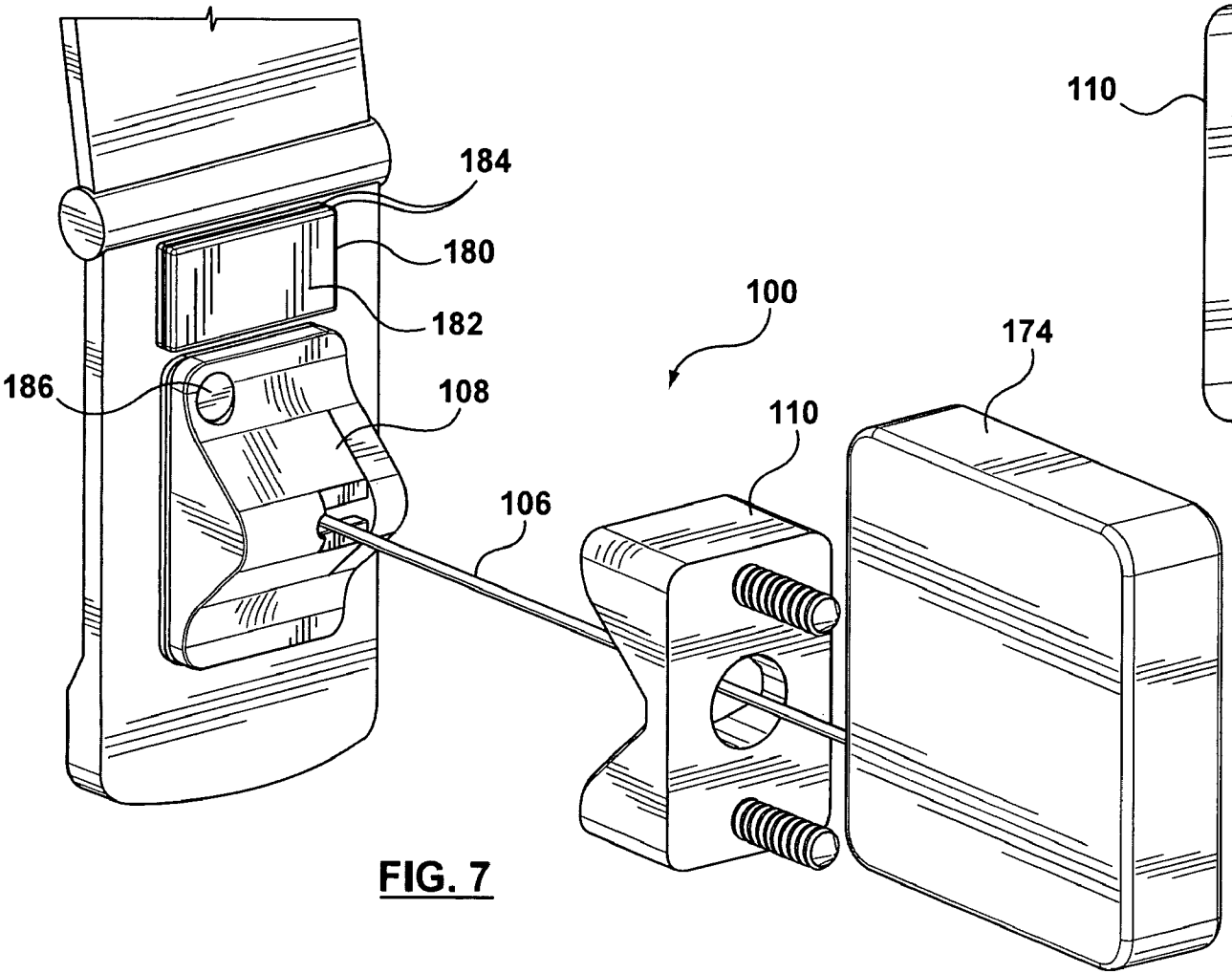
FIG. 7 is a perspective view showing a security mount according to a further embodiment.

FIGS. 7 and 8 illustrate another embodiment of the security mount 100, which is identical to the security mount 100 of FIGS. 1 to 6 except that the security mount shown in FIG. 7 and 8 includes a magnetic insert 186 received in a recessed seat of the back surface of the device mount 108 that cooperates with a corresponding magnetic insert 188 that is received in a recessed seat on the forward surface of the base mount 110. The device mount magnetic insert 186 aligns with the base mount magnetic insert 188 when the device mount 108 is retracted back to the base mount 110 such that the magnetic attraction between inserts 186 and 188 helps to keep the two mounts aligned and together when in the retracted position. Both the inserts may be permanent magnets with suitably oriented poles to allow them to attract to each other, or only one of the inserts may be a permanent magnet with the other being non-magnetized steel for example.

As shown in FIG. 7, in one example embodiment a rectangular rigid battery securing member 180 is provided. The battery securing member 180 has double sided tape 184 provided on a rigid body 182 and can be secured to the back side of the mobile device over a battery release tab or latch in order to prevent the back cover of the mobile device from being released. Such a feature allows the device mount 108 to be attached to a releasable battery portion or cover of a mobile device.

Figure 9:
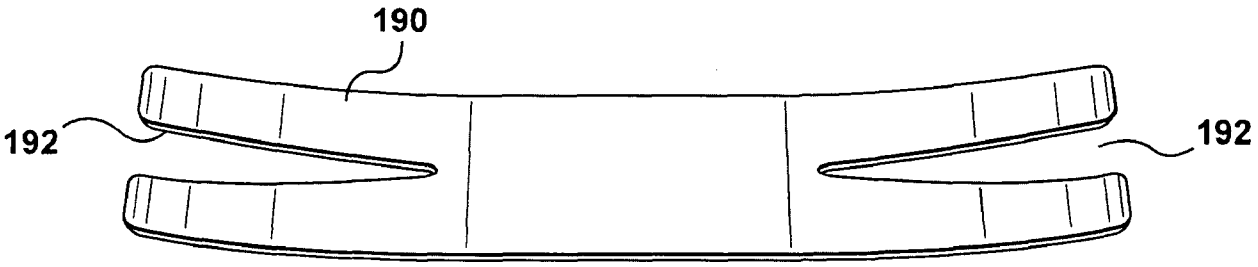
FIG. 9 is a perspective view of a cable retaining tool according to an example embodiment.
Figure 10:
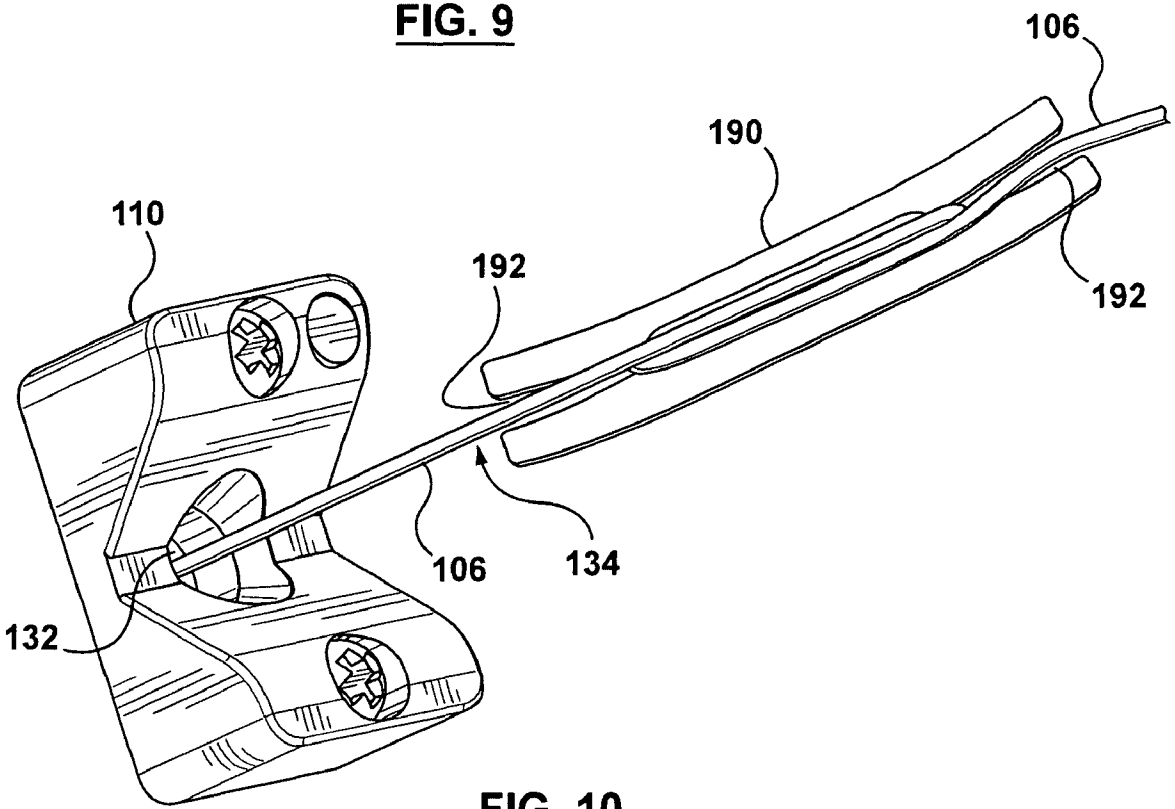
FIG. 10 is a perspective view of the cable retaining tool in use.

As shown in FIGS. 9 and 10, in one example embodiment a releasable cable retaining tool 190, which as illustrated includes two V-shaped openings 192 at opposite ends, can be used to stop the tether 106 from retracting through the hole 132 in the base unit 110 when the tether 106 has been removed from the device mount 108. FIG. 10 shows the tether cable 134 wrapped around the cable retaining tool 190. The tool 190 is too large to fit through the base opening 132, thereby preventing the tether 106 from retracting.

Figure 11:
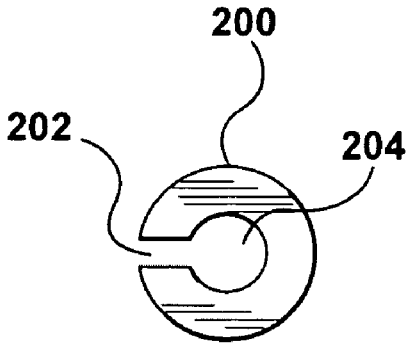
FIG. 11 is a front view of a base mount insert for use with a base mount.
Figure 12:
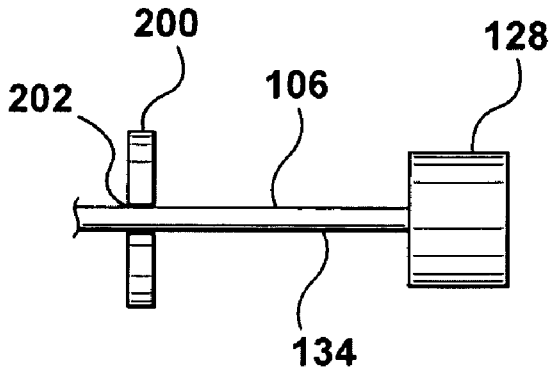
FIG. 12 is a side view of the base mount insert of FIG. 11.
Figure 13:
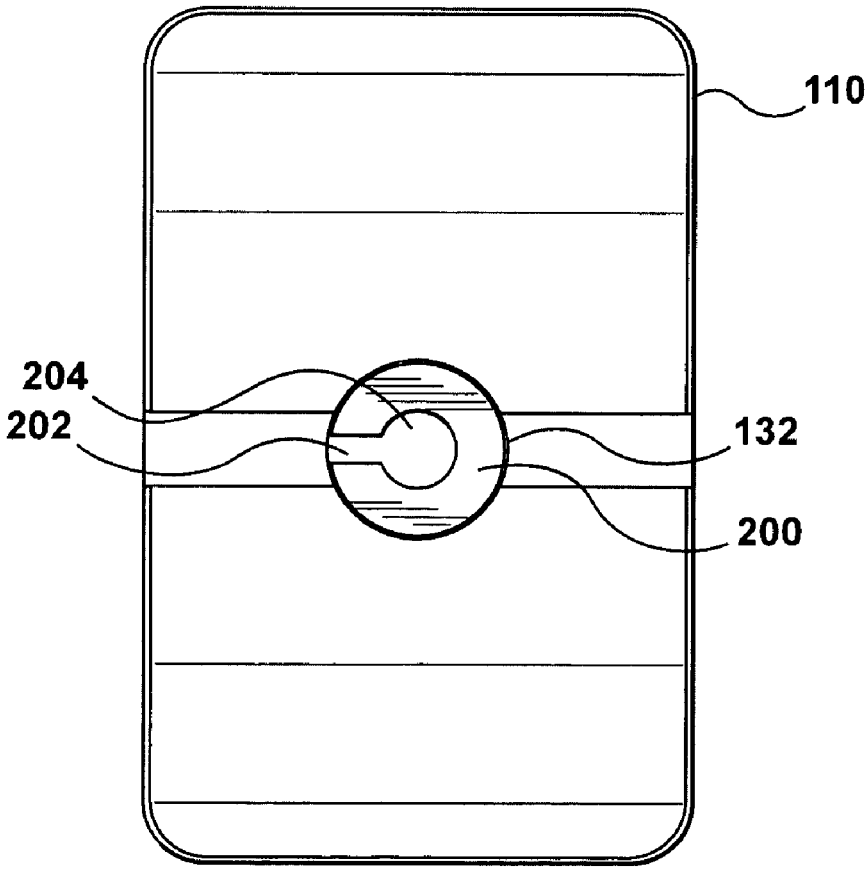
FIG. 13 is a front view of the base mount insert of FIG. 11 secured in a base mount.

As shown in FIGS. 11 to 13, in one example embodiment a circular cable stop insert 200 can be placed in a corresponding recessed seat formed around the base mount opening 132 in the front surface of the base mount 110 to act as a stop to prevent the tether 106 from retracting through the base mount 110 when the tether detached from the device mount 108. The cable stop insert 200 defines a groove 200 leading from its outer edge to a central opening 204. The opening 204 is large enough to allow the tether cable 134 to easily slide through, but small enough to prevent the enlarged terminal tether end 128 to pass through. During installation, the tether end 128 is passed through the base mount opening 132 from back to front, and the cable stop insert 200 then slipped on to the tether cable 134 behind the enlarge terminal end 128 and in front of the base mount 110, and then settled into its recessed seat in the front surface of the base mount 110, thus preventing the terminal end 128 from retracting back through the opening 132 unless the cable stop insert 200 is removed. The insert 200 may be configured to snap-fit into its corresponding recessed seat in the base mount 110 so that directed force beyond simple movement of the tether cable is required to remove it.

Figure 14:
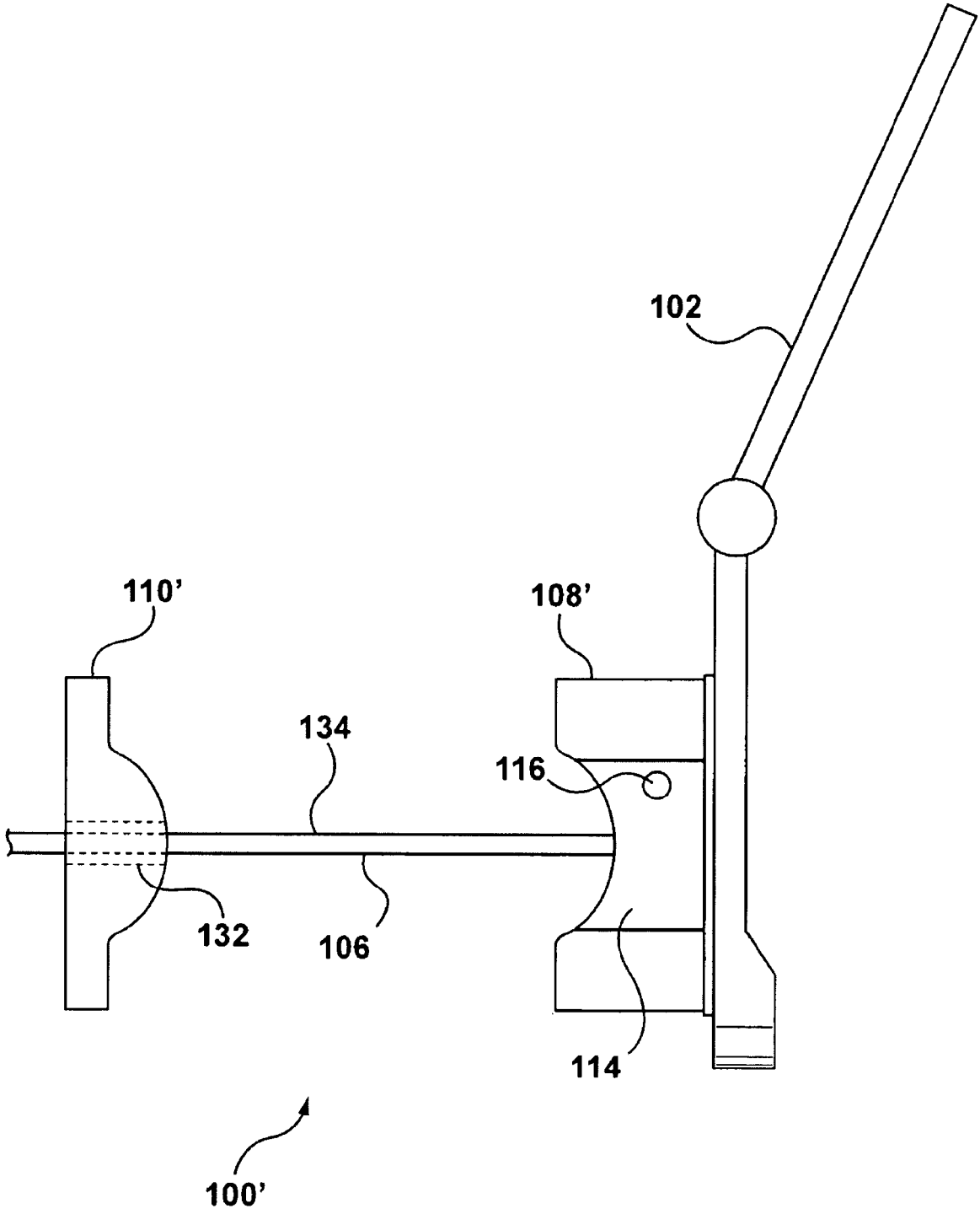
FIG. 14 is a side view showing a security mount according to another example embodiment.

Although a wedge shaped male device mount and complementary V-shaped base mount have been described above for automatically aligning the device mount 108 and the base mount 110 when they are retracted together, other complementary shapes on the cooperating surfaces of the device mount 108 and the base mount 110 can be used to provide automatic alignment. For example a projecting elliptical shape on the back of the device mount 108 could cooperate with a corresponding shaped recess in the base mount 110 to provide automatic alignment. In some example embodiments, the male portion of the auto-aligning structure could be on the base mount and the female portion on the device mount. In this regard, FIG. 14 illustrates a further example embodiment of a security device 100' that is similar in construction and operation to security device 100 except that the device mount 108' includes a female recess on its back side for cooperating with a complimentary shaped male portion on the front side of base mount 110'. The female recess and male portion could have complementary wedge and V shapes as described above in respect of security mount 100, or have other complimentary shapes such as semicircular or semispherical for example. Similar to device mount 108, the device mount 108' includes a releasable side cover 116 covering an internal cavity that retains the enlarged terminal end of tether 106. Magnetic inserts 186, 188 can also be used with security mount 100.

Additionally, a security mount 100 that includes device mount 108 and cover 114 combination for releasably securing the enlarged end of a tether 106 can take many different configurations in addition to what is shown in the Figures. In some example embodiments for example, the cavity 146 and passage 148 may be partially defined by the cover 114.

Figure 15:
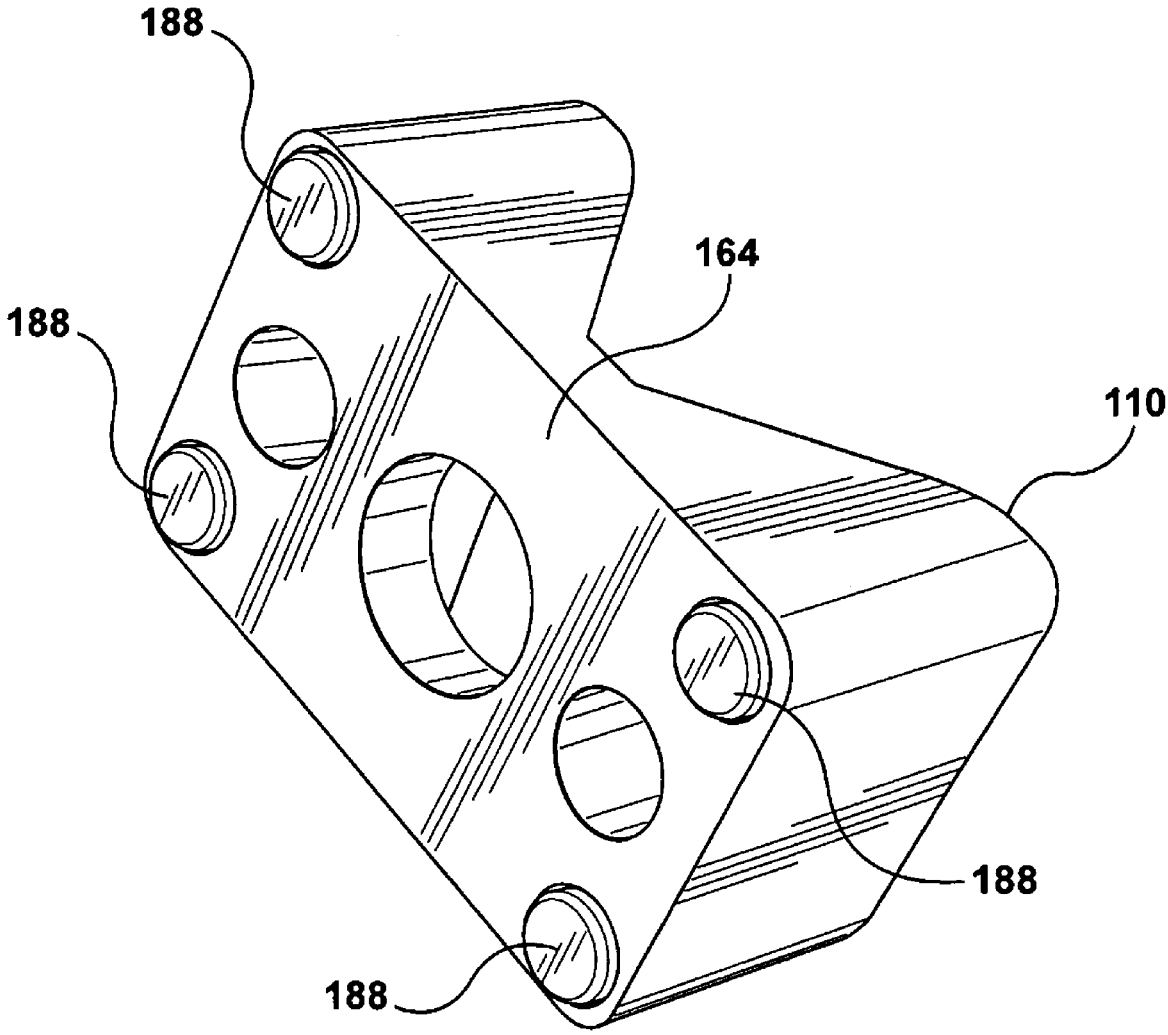
FIG. 15 is a back perspective view of a base mount of the security mount, according to another example embodiment.
Figure 16:
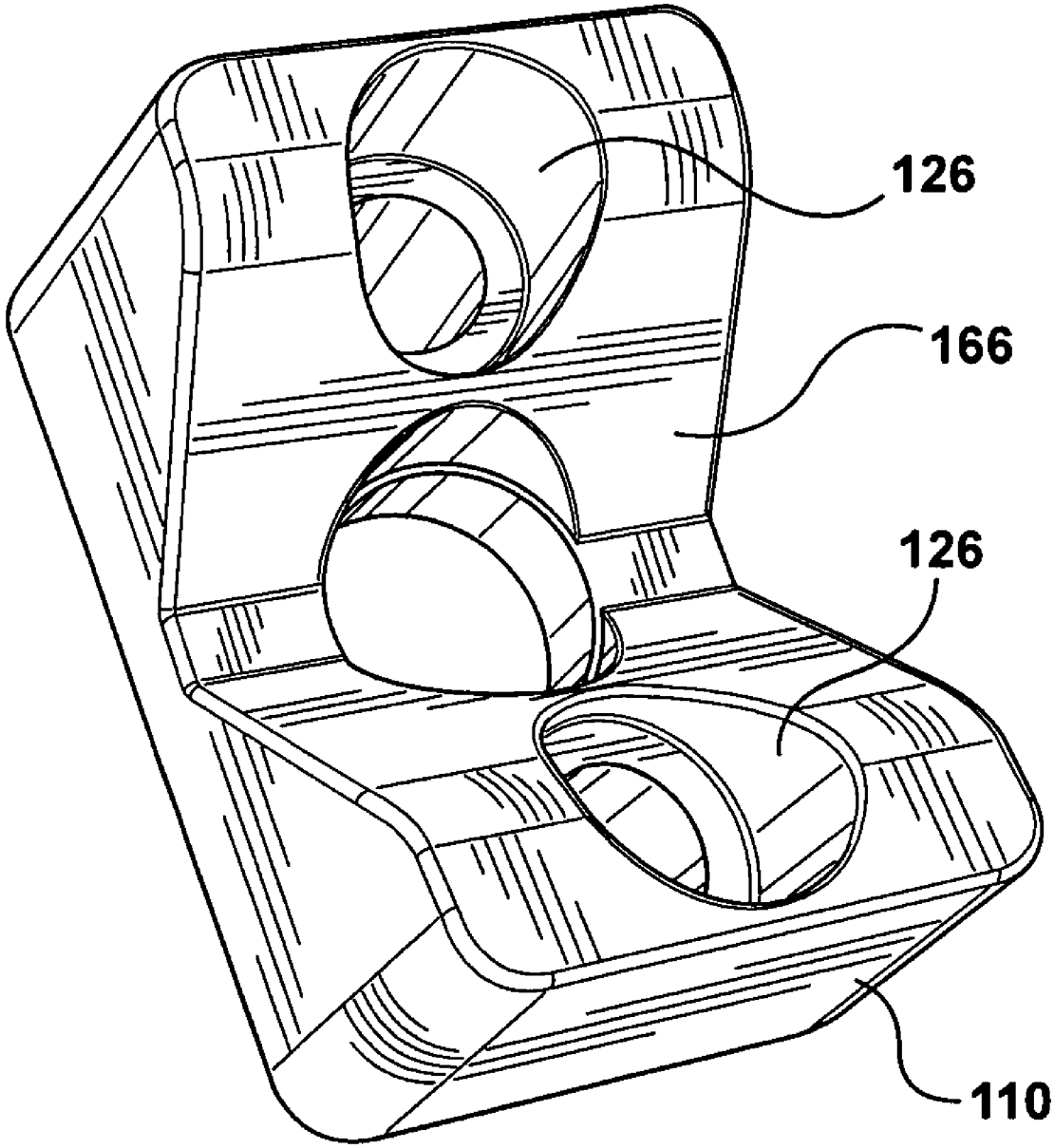
FIG. 16 is a front perspective view of the base mount of FIG. 15.
Figure 17:
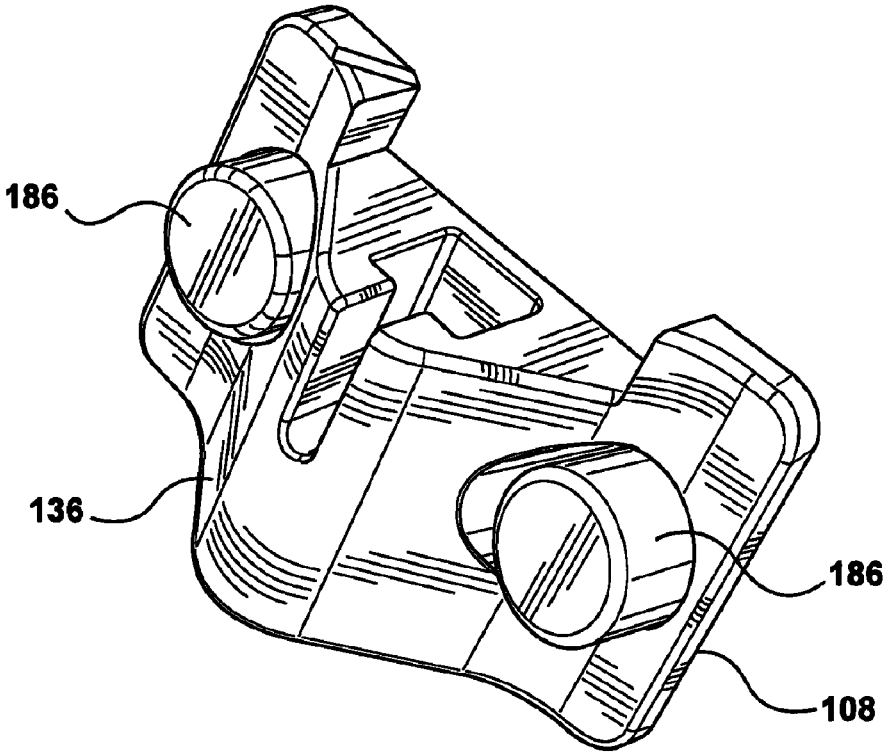
FIG. 17 is a back perspective view showing a device mount of the security mount, according to another example embodiment.
Figure 18:
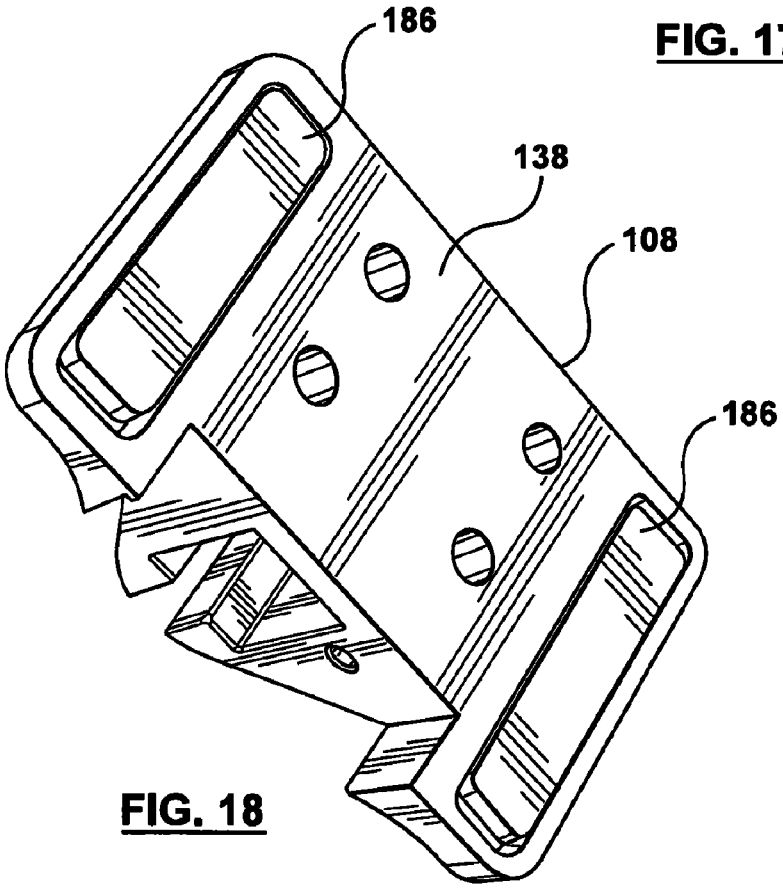
FIG. 18 is a front perspective view showing a device mount of the security mount, according to another example embodiment.

As noted above, magnetic members or inserts 186, 188 can be provided to provide attractive forces between the base mount 110 and device mount 108 when the device mount is located close to the base mount. FIGS. 15-18 illustrate different arrangements for magnetic inserts that can be applied to the security mounts 10, 100' described above. For example, in one embodiment as shown in FIG. 15, the base mount 110 can define four cylindrical chambers accessible from the back side 164 of the base mount, with each opening receiving a respective cylindrical magnetic insert 188. In such a configuration, as can be seen in FIG. 16, the base mount magnetic inserts 188 are not exposed on the front side 166 of the base where they might otherwise become a trap for magnetic lint particles. As shown in FIG. 17, in one example embodiment, the device mount magnetic inserts 186 may be short cylindrical members that are secured to the back side 136 of the device mount 110 such that they align with and are partially received in the respective screw openings 126 of the base mount 110 when the security mount is in a tethered position. As shown in FIG. 18, in another example embodiment, the device mount magnetic inserts 186 are rectangular members received within corresponding rectangular slots formed on the front surface 138 of the device mount 138.

Other variations and alternatives are possible in respect of the example embodiments described above.

What is claimed is:

1. A mounting assembly for releasably securing a handheld device to a tether having an enlarged terminal portion at an end of a tethering cable, comprising:

a rigid device mount securable to a surface of the handheld device for securing the enlarged terminal portion of the tether to the handheld device, the device mount defining an internal cavity for receiving the enlarged terminal portion of the tether, and a cable passage for receiving a section of the tethering cable adjacent the enlarged terminal portion, the cable passage extending from the internal cavity to an outer surface of the device mount, the device mount defining an access opening communicating with the internal cavity and the cable passage at a first side of the device mount to permit the enlarged terminal portion and the tethering cable section to be positioned into and removed from the internal cavity and the cable passage, respectively;

a cover releasably securable to the device mount to cover the access opening when the cover is in a secured position to prevent removal of the tether from the device mount; and a fastener releasably securing the cover to the device mount in the secured position, wherein the cover and fastener are disposed to allow the cover to be released from the secured position when the device mount is secured to the handheld device, thereby enabling the tether to be released from the device mount when the device mount is secured to the handheld device.

2. The mounting assembly of claim 1 wherein the fastener includes a threaded screw that passes through the cover and into a threaded bore in the device mount, the threaded screw having a keyed head for receiving a complimentarily keyed interface of a tool for removing or securing the fastener.

3. The mounting assembly of claim 1 wherein the device mount defines a nested seat in the first side at least partially surrounding the access opening, the cover sitting in the nested seat when in the secured position.

4. The mounting assembly of claim 1 wherein the device mount comprises a front side having a surface for engaging the handheld device, the mounting assembly including an adhesive interface on the front side for securing the device mount to the handheld device.

5. The mounting assembly of claim 1 wherein the device mount comprises a front side having a surface for engaging the handheld device, and a back side defining an opening to the cable passage at the outer surface of the device mount, the first side extending from the front side and the back side.

6. The mounting assembly of claim 1 further comprising a battery securing member comprising a rigid body having securing adhesive on one side thereof for securing over a portion of a battery cover the handheld device.

7. The mounting assembly of claim 1 further comprising a base mount for mounting to a support structure and having an outer facing front surface for engaging the back side of the device mount as the device mount is retracted towards the base mount, the base mount front surface and device mount back surface each having a complimentary shape such that the device mount is biased to a predetermined orientation relative to the base mount as the device mount back surface is retracted into engagement with the base mount front surface.

8. A mounting assembly for releasably securing a handheld device to a tether having an enlarged terminal portion at an end of a tethering cable, comprising:

a rigid device mount securable to a surface of the handheld device for securing the enlarged terminal portion of the tether to the handheld device, the device mount defining an internal cavity for receiving the enlarged terminal portion of the tether, and a cable passage for receiving a section of the tethering cable adjacent the enlarged terminal portion, the cable passage extending from the internal cavity to an outer surface of the device mount, the device mount defining an access opening communicating with the internal cavity and the cable passage at a first side of the device mount to permit the enlarged terminal portion and the tethering cable section to be positioned into and removed from the internal cavity and the cable passage, respectively;

a cover releasably securable to the device mount to cover the access opening when the cover is in a secured position to prevent removal of the tether from the device mount; and a base mount for mounting to a support structure and having an outer facing front surface for engaging the back side of the device mount as the device mount is retracted towards the base mount, the base mount front surface and device mount back surface each having a complimentary shape such that the device mount is biased to a predetermined orientation relative to the base mount as the device mount back surface is retracted into engagement with the base mount front surface, wherein the front surface of the base mount defines a recess and the device mount back surface defines a complimentary shaped protruding surface.

9. A mounting assembly for releasably securing a handheld device to a tether having an enlarged terminal portion at an end of a tethering cable, comprising:

a rigid device mount securable to a surface of the handheld device for securing the enlarged terminal portion of the tether to the handheld device, the device mount defining an internal cavity for receiving the enlarged terminal portion of the tether, and a cable passage for receiving a section of the tethering cable adjacent the enlarged terminal portion, the cable passage extending from the internal cavity to an outer surface of the device mount, the device mount defining an access opening communicating with the internal cavity and the cable passage at a first side of the device mount to permit the enlarged terminal portion and the tethering cable section to be positioned into and removed from the internal cavity and the cable passage, respectively;

a cover releasably securable to the device mount to cover the access opening when the cover is in a secured position to prevent removal of the tether from the device mount; and a base mount for mounting to a support structure and having an outer facing front surface for engaging the back side of the device mount as the device mount is retracted towards the base mount, the base mount front surface and device mount back surface each having a complimentary shape such that the device mount is biased to a predetermined orientation relative to the base mount as the device mount back surface is retracted into engagement with the base mount front surface, wherein the device mount back surface defines a recess and the front surface of the base mount defines a complimentary shaped protruding surface.

10. The mounting assembly of claim 7 wherein the base mount defines a central opening and includes a cable stop insert for removable insertion at least partially into the central opening to prevent the enlarged terminal portion of the tether from retracting through the central opening, the cable stop insert defining a passage that the tethering cable can pass through.

11. The mounting assembly of claim 7 further including magnetic members mounted in each of the base mount and the device mount for applying attractive forces to releasably secure the device mount to the base mount.

12. The mounting assembly of claim 11 wherein the base mount defines at least one chamber accessible from a back side thereof, and the magnetic members includes a magnetic insert received within the one chamber.

13. A security device for releasably securing an article, comprising:

a retracting mechanism including a retractable tether having an enlarged terminal portion at an end of a tethering cable;

a device mount assembly comprising: (i) a rigid device mount body securable to the article for securing the enlarged terminal portion of the tether to the article and for movement with the article between a tethered extended position and a tethered retracted position, the device mount body defining an internal cavity receiving the enlarged terminal portion of the tether, and a cable passage for receiving a section of the tethering cable adjacent the enlarged terminal portion, the cable passage extending from the internal cavity to an outer surface of the device mount body, the device mount body defining an access opening communicating with the internal cavity and the cable passage to permit the enlarged terminal portion and the tethering cable section to be positioned into and removed from the internal cavity and the cable passage, respectively and (ii) a cover releasably secured to the device mount body to cover the access opening when the cover is in a secured position to prevent removal of the tether from the device mount body; and a base mount for mounting to a support structure and having an outer facing front surface for engaging the device mount body when the device mount body is retracted towards the base mount to the tethered retracted position, wherein the device mount body defines a nested seat in a first side thereof at least partially surrounding the access opening, the cover sitting in the nested seat when in the secured position.

14. The security device of claim 13 comprising a fastener releasably securing the cover to the device mount body in the secured position, the cover and fastener being disposed such that the cover can be released from the secured position when the device mount body is secured to the article, thereby enabling the tether to be released from the device mount body when the device mount body is secured to the article.

15. The security device of claim 14 wherein the fastener includes a threaded screw that passes through the cover and into a threaded bore in the device mount body, the threaded screw having a keyed head for receiving a complimentarily keyed interface of a tool for removing or securing the fastener.

16. The security device of claim 13 wherein the device mount body comprises a front side having a surface for engaging the handheld device, and a back side defining an opening to the cable passage at the outer surface of the device mount, the first side extending from the front side and the back side.

17. The mounting assembly of claim 13 wherein the base mount defines a passage and includes a cable stop insert for removable insertion at least partially into the passage to prevent the enlarged terminal portion of the tether from retracting therethrough, the cable stop insert defining a further passage that the tethering cable passes through.

18. A mounting assembly for releasably securing a handheld device to a tether having an enlarged terminal portion at an end of a tethering cable, comprising:

a rigid device mount securable to a handheld device, the device mount defining an internal cavity for receiving the enlarged terminal portion of the tether, and a cable passage for receiving a section of the tethering cable adjacent the enlarged terminal portion, the cable passage extending from the internal cavity to an outer surface of the device mount, the device mount defining an access opening communicating with the internal cavity and the cable passage at a first side of the device mount to permit the enlarged terminal portion and the tethering cable section to be positioned into and removed from the internal cavity and the cable passage, respectively;

a cover releasably securable to the device mount to cover the access opening when the cover is in a secured position to prevent removal of the tether from the device mount; and a fastener releasably securing the cover to the device mount in the secured position;

wherein the cover and fastener are disposed to allow the cover to be released from the secured position when the device mount is secured to the handheld device, thereby enabling the tether to be released from the device mount when the device mount is secured to the handheld device.

* * * * *